US007402039B1

(12) United States Patent
McElroy

(10) Patent No.: US 7,402,039 B1
(45) Date of Patent: Jul. 22, 2008

(54) HIGH VELOCITY PRESSURE COMBUSTION SYSTEM

(76) Inventor: James G. McElroy, 26514 S. Barnett, Magnolia, TX (US) 77355

( * ) Notice: Subject to any disclaimer, the term of this patent is extended or adjusted under 35 U.S.C. 154(b) by 184 days.

(21) Appl. No.: 10/941,239

(22) Filed: Sep. 15, 2004

Related U.S. Application Data

(63) Continuation-in-part of application No. 10/801,264, filed on Mar. 16, 2004, now abandoned.

(60) Provisional application No. 60/455,383, filed on Mar. 17, 2003.

(51) Int. Cl.
*F23D 14/62* (2006.01)
*F23L 17/00* (2006.01)

(52) U.S. Cl. ..... 431/354; 431/157; 431/9

(58) Field of Classification Search ..... 431/157, 431/9, 19, 217, 350, 181, 185, 8, 354
See application file for complete search history.

(56) References Cited

U.S. PATENT DOCUMENTS

| | | | |
|---|---|---|---|
| 1,302,819 | A | 5/1919 | Lucke |
| 1,308,364 | A | 7/1919 | Lucke |
| 1,946,971 | A | 2/1934 | Harter |
| 2,440,491 | A | 4/1948 | Schwander |
| 2,511,380 | A | 6/1950 | Stadler |
| 2,904,417 | A | 9/1959 | Nayl |
| 2,975,047 | A | 3/1961 | Leroy |
| 2,987,118 | A | 6/1961 | Brown |
| 3,001,576 | A | 9/1961 | Biber |
| 3,186,040 | A | 6/1965 | Adamo |
| 3,188,366 | A | 6/1965 | Flynn |
| 3,208,247 | A | 9/1965 | Well |
| 3,232,593 | A | 2/1966 | Flynn |
| 3,291,472 | A | 12/1966 | Hoff |
| 3,299,940 | A | 1/1967 | Phillips |
| 3,358,979 | A | 12/1967 | Flynn |
| 3,377,024 | A | 4/1968 | Nutten |

(Continued)

*Primary Examiner*—Alfred Basichas
(74) *Attorney, Agent, or Firm*—Conley Rose, P.C.

(57) ABSTRACT

A high velocity pressure burner system burns air and gas thereby creating a flue gas. The system comprises a blower for pressurizing the air; a control for adjusting the pressure of the pressurized air; a combustion chamber having a flue gas outlet; and a burner disposed on the combustion chamber. The burner includes an air orifice for receiving the pressurized air; a gas orifice for receiving the gas; the air orifice causing the pressured air to flow over the gas orifice to form an air/gas mixture; at least one spinner vane disposed upstream of the gas orifice creating turbulence in the air/gas mixture; and a retender disposed downstream of the gas orifice creating turbulence in the air/gas mixture. The flue gas outlet is sized to create a back pressure on the burning air/gas mixture. The flue gas from the combustion of the air/gas mixture in the combustion chamber increases in velocity as the flue gas passes through the flue gas exit. The high velocity pressure burner system is disposed on a vessel for heating the vessel such as a boiler. The boiled includes an exhaust stack sized to maintain a back pressure on the flue gas passing through the boiler. To eliminate the CO and reduce the NOX to less than 10 PPM, the burner is operated at a lower temperature of 2200° F. The vessel is then heated by forced convection heat transfer maintaining the velocity of the flue gas through the vessel at a velocity which is compatible with the insulation lining the vessel.

25 Claims, 6 Drawing Sheets

U.S. PATENT DOCUMENTS

| | | | | |
|---|---|---|---|---|
| 3,480,375 | A | | 11/1969 | Sitte |
| 3,485,566 | A | | 12/1969 | Schoppe |
| 3,644,076 | A | | 2/1972 | Bagge |
| 3,663,153 | A | | 5/1972 | Bagge et al. |
| 3,676,048 | A | | 7/1972 | Sellers, Jr. |
| 3,695,817 | A | | 10/1972 | Sharan |
| 3,721,517 | A | | 3/1973 | Osthoff |
| 3,726,634 | A | | 4/1973 | Thomson et al. |
| 3,736,094 | A | | 5/1973 | Shisler |
| 3,741,710 | A | | 6/1973 | Nelson |
| 3,749,548 | A | | 7/1973 | Zink et al. |
| 3,782,881 | A | | 1/1974 | Feeney |
| 3,828,700 | A | | 8/1974 | Ragot |
| 3,838,975 | A | | 10/1974 | Tabak |
| 3,880,571 | A | | 4/1975 | Koppang et al. |
| 3,892,190 | A | | 7/1975 | Sharpe |
| RE28,665 | E | | 12/1975 | Zagoroff |
| 3,998,581 | A | | 12/1976 | Hemingway et al. |
| 4,003,692 | A | | 1/1977 | Moore |
| 4,012,189 | A | | 3/1977 | Vogt et al. |
| 4,033,512 | A | | 7/1977 | Beck |
| 4,067,682 | A | | 1/1978 | Lado |
| 4,082,495 | A | * | 4/1978 | Lefebvre ..... 431/183 |
| 4,120,639 | A | | 10/1978 | Thekdi et al. |
| 4,125,364 | A | | 11/1978 | Stephens |
| 4,218,212 | A | | 8/1980 | Eschenberg et al. |
| 4,309,165 | A | | 1/1982 | McElroy |
| 4,408,567 | A | * | 10/1983 | Morton ..... 122/14.21 |
| 4,410,308 | A | | 10/1983 | McElroy |
| 4,431,403 | A | * | 2/1984 | Nowak et al. ..... 431/183 |
| 4,556,386 | A | | 12/1985 | McElroy |
| 4,628,835 | A | | 12/1986 | Wollner |
| 4,764,105 | A | | 8/1988 | McElroy |
| 4,854,853 | A | * | 8/1989 | McElroy ..... 431/115 |
| 5,310,337 | A | * | 5/1994 | Lifshits et al. ..... 431/174 |
| 6,435,862 | B1 | * | 8/2002 | Fioriti et al. ..... 431/354 |

* cited by examiner

HIGH VELOCITY PRESSURE COMBUSTION SYSTEM

CROSS-REFERENCE TO RELATED APPLICATION

The present application is a continuation-in-part of U.S. application Ser. No. 10/801,264, filed Mar. 16, 2004 now abandoned and entitled High Velocity Pressure Combustion System, and further claims the benefit of 35 U.S.C. 119(e) of U.S. provisional application Ser. No. 60/455,383, filed Mar. 17, 2003 and entitled Pressure Combustion System, both hereby incorporated herein by reference in their entirety.

BACKGROUND OF THE INVENTION

The present invention relates to apparatus and methods for heating and more particularly to systems utilizing high pressure combustion air and high velocity flue gas and still more particularly to a combustion system for boilers producing low NOX and CO in the stack emissions.

Heat exchangers function to remove or add heat from one fluid to another. A common heat exchanger used in industrial applications involves a plurality of parallel tubes with one fluid flowing through the tubes and another fluid flowing across the tubes thereby exchanging heat. Such an exchanger is preferably constructed such that the two fluids are not allowed to mix and that the heat from one fluid is transferred to the other fluid through the walls of the tubes. This type of exchanger is often employed in industrial boilers. In a boiler, a burner combusts a mixture of air and gas to create hot flue gases. These hot gases pass through the boiler and across the tubes, sometimes called water tubes. Heat is transferred from the hot flue gasses across the tube walls and into the fluid that is being heated, usually water (water tube boilers) or some type of crude oil or derivates thereof (petro-chemical boilers). The hot flue gases pass through the exhaust stack and are emitted into the atmosphere.

Various types of burners are used with boilers. Atmospheric burners may be used but provide the poorest control of the flame, allow only incomplete and uneven combustion of hydrocarbon fuel, normally gas, and also provide poor heat transfer through the tube walls. The deficiencies in transferring heat through the tube walls of water or petro-chemical boilers, is always on the gas side of the tube walls over which the hot flue gases flow.

Stack draft is a problem for a process heat vessel of any kind or description. It causes all sorts of problems from incomplete complete combustion, uneven heat transfers, to a reduction of draft when the units are trying to increase heat input.

Also atmospheric burners and all long flame forced draft (blower air) burners have to have a stack draft to function. Stack drafts draw in air, flame and combustion gases through the boilers on a path of least resistance which results in a wide variation of heat transfer through the tube walls. Normally these stack drafts are in the −3" to 4" water column (w.c.) range, i.e., negative pressure caused by a negative partial vacuum.

The controls for prior art burners are located at the inlet side of the burner and are subject to stack draft-negative pressure.

Prior art boilers and petro-chemical heaters also have the problem of soot (coke) build-up on the insulation walls around the tubes. All of the petrochemical units have excessive tube warpage caused by uneven heat and hot spots. This coking, warpage, uneven heat distribution and hot spots also cause internal problems on the fluid side of the tube wall.

The government is highly regulating emissions into the atmosphere from vessels heated by combustion. In particular emissions from exhaust stacks from heat exchangers or boilers are required to have a low content of CO and NOX.

Atmospheric burners have high pressure (psi) gas orifices that entrain atmospheric air into the gas stream in order to get the fire started. Then the exhaust stack draft dominates to draw in the balance of the air passing through the boiler. How much air is drawn in is not known, but it is a lot more than is normally needed for good combustion, i.e., excess air. Regardless of the percentage of excess air used over that required for combustion, the excess air causes the boiler to produce an atrocious amount of CO which is very undesirable.

Prior art burners have no control over the flames in their burners. All of the prior art atmospheric burners and primary forced draft burners with the two valve control system cannot be controllable at any set NOX emission number. For instance, the John Zink Company markets and guarantees a burner that will only produce 7 parts per million (PPM) NOX. The Zink burner will produce such low NOX emissions as long as the controller does not move the valves in the system. If the valves move, the system becomes uncalibrated and will no longer return to the low 7 PPM NOX. This is true of all two-valve systems because they have no controllability. Also if the NOX emissions change, then the CO emissions change and the ratio of air/gas mixture also change.

To lower NOX, prior art burners have attempted to use excess air, which in turn lowers the maximum flame temperature. However, when the prior art burners increase excess air, the NOX emissions come down but the CO emissions increase.

All of the atmospheric burners and the forced draft burners have long blue flames. Blue fires are in the ultra violet light range and therefore are very poor emitters of radiant heat.

Still further the long flames of prior art burners start getting erratic at about 30 PPM NOX and very few will reduce the NOX down to 20 PPM. The flames have been known to get so erratic at sub 30 PPM that the U.V. (ultra-violet) flame scanner will lose sight of the flame and shut down the burner.

Summarizing, the burners presently being used by the boiler industry have elongated flames and attempt to control combustion with a two valve system (one on the air and one on the gas) which is impossible to control on ratio and is not repeatable. These fires are not controllable as they rely on a negative stack draft to operate. They will not operate at positive pressure therefore they will not furnish high velocity forced convection heat transfer. They lack uniformity and by the nature of the long lazy flames, they cause coking because they cannot burn the CO. A negative pressure causes hot spots, uneven heat distribution across tubes, incomplete combustion which leaves CO (unburned fuel) in the exhaust emissions. The CO cools the tubes and causes soot or coke on the tubes. Soot also interferes with heat transfer. A stack draft also loses some of its pulling power at the higher firing rates when things are hotter; this is when more negative draft is required.

The advent of forced draft burners, using combustion air blowers, resulted in a vast improvement in BTU's per hour per cubic foot combustion space. This was made possible by improved air-gas mixing. These forced draft burners, however, still require a stack draft of 2" to 4" w.c. and still produce long uncontrolled flames but shorter with faster burns than atmospheric burners. Normally the forced draft burners operate best with 8" w.c. air pressure or less. They still have no control of their flames.

Area or refractory lined combustion blocks may be required by some firing rates (BTUH per cubic foot) or design requirements.

My prior art U.S. Pat. Nos. 4,309,165; 4,410,308; and 4,556,386, hereby incorporated herein by reference, disclose a diffuser head which is angled to the outside at a lesser angle than a flat surface. Such diffusers are made of low carbon steel that perform quite well, 10 years plus service life. The prior art diffuser head tends toward a blue flame and extends in length at the higher excess air flow rates. These prior art patents have a higher flame temperature and rely upon radiant heat rather than forced convection.

The present invention overcomes the deficiencies of the prior art.

SUMMARY OF THE INVENTION

A high velocity pressure burner system burns air and gas thereby creating a flue gas. The system comprises a blower for pressurizing the air; a control for adjusting the pressure of the pressurized air; a combustion chamber having a flue gas outlet; and a burner disposed on the combustion chamber. The burner includes an air orifice for receiving the pressurized air; a gas orifice for receiving the gas; the air orifice causing the pressured air to flow over the gas orifice to form an air/gas mixture; at least one spinner vane disposed upstream of the gas orifice creating turbulence in the air/gas mixture; and a retender disposed downstream of the gas orifice creating turbulence in the air/gas mixture. The flue gas outlet is sized to create a back pressure on the burning air/gas mixture. The flue gas from the combustion of the air/gas mixture in the combustion chamber increases in velocity as the flue gas passes through the flue gas exit.

The combustion system controls are linear because of a proportionator valve gas control. This control system will keep the combustion mix in steady proportion of air to gas over the entire firing range of the burner. The combustion is repeatable even after adjustment, i.e., 100% excess air on high fire will be 100% excess air on low fire. The burner of the combustion system uses pressure drop across orifices, one on the air and one on the gas, to control the flows of air and gas linearly and on the same ratio of air to gas rather than using the prior art mechanical valve means that don't work.

A V.F.D. (variable frequency drive) AC motor provides superior air control results. The V.F.D. motor costs more than the other systems but will eventually pay for itself in electric power savings. A proportionator valve is simply a "zero governor" pressure reducing regulator with a counter balance spring under the diaphragm. A zero governor takes gas in at some positive pressure and lets it out at atmospheric pressure, i.e., 14.7 psia. By back loading the top of the diaphragm of the proportionator valve with the operating air pressure (that being supplied to the air orifice), the proportionator valve assumes that this is a new atmospheric pressure. The proportionator valve now supplies gas out to its limiting orifices at the identical pressure as the operating air pressure. This arrangement makes the gas a slave of the air. If the mix is 10:1 air to gas on maximum fire, it will be 10:1 on minimum fire. This is true linear control of gas-air mix and is the only control system that will control linearly. This means the emissions will be the same in parts per million on high or low fire. The air limiting orifice is built in and not adjustable. The gas passes through an adjustable gas limiting orifice, when the gas pressure on the gas limiting orifice is reduced; the air flow through the air limiting orifice is also reduced. The same thing happens to the gas flow through the gas limiting orifice, since it is receiving gas at the same pressure as the air. Hence, there is an automatic linear control of cubic feet per hour air/gas mix. The V.F.D. motor on the blower eliminates the need for any type of valve arrangement (butterfly or wafer) or register in the air line.

The pressure burner is designed and built to operate against a back pressure or positive pressure on the downstream side of the fire. This extends the range of control through the fire, through the heat transfer, and out the flue gas outlet. A reduced port size in the combustion block may or may not be used depending on the BTU's per square foot of combustion required. Positive pressure compresses the components of the combustion close together which, along with the added turbulence by positive pressure, results in a short compact flame. Positive pressure also results in the entire metal tube surface of the boiler having hot gases scrubbed across it. This results in increased forced convection heat transfer along with uniformity. Even with the reduced temperature in the flue gas lowering the radiant heat transfer rate, significant heat transfer is not lost due to the refractory insulation being in closer proximity to the tubes.

The pressure combustion system is designed to burn air-gas mix with +2 to 4" water column (w.c.) pressure on the flame, i.e., back pressure. The burner will not burn back (or flame back) causing soot (or coking) at the gas injection orifices which will result in cessation of gas flow through orifices. Back pressure on the flame in the combustion area or refractory lined combustion block may be required by some firing rates (BTUH per cubic foot) or other design requirements.

To date, no inexpensive system for increasing the heat flux through the tubes of a heat exchanger has been suggested that operates with a low pressure drop. The present invention overcomes the deficiencies of the prior art through the use of a burner operating at a positive pressure on the fire and furnishing high velocity forced convection heat transfer.

Good combustion requires time, temperature, and turbulence. Time is typically considered to be the most important and turbulence the least important. Their priority needs to be rearranged. Turbulence should be the most important because it dictates time and temperature for combustion. The burner is designed to exert maximum turbulence in the fire which drastically reduces time and space required to attain clean complete combustion.

Various turbulence means are provided in the present invention including the aspirating means, spinner vanes and a retender.

The aspirating means includes an air venturi which pulls a partial vacuum on the gas, which makes the gas a slave of the air and is automatically maintained at the same pressure as the air by a proportionator valve. The air venturi gives a micro mix of gas in the air stream and the upstream side of the retender completes the almost instantaneous micro mixing while causing maximum turbulence in the flame. Thus, the burner achieves a micro mix of the air and gas flowing out of the venturi.

The burner includes spinner vanes on the gas manifold upstream of the gas orifices to aid and increase the rate of spin that is provided naturally by the air flow. Spinner vanes are used on the blower air passing through the air venturi-orifice. The spinner vanes on the upstream side of the gas orifices further flatten and shorten the flame. The increased spin of the air gives an increased turbulent mix. The spinner vanes assist the spin of the air through the air-orifice-venturi which helps the mixing of the air-gas and adds turbulence.

The burner includes a flame retention head called a retender. The retender aids in slowing or stopping the forward thrust of the mix stream exiting the venturi mixer, and adding turbulence to the combustible mix. The retender surface is at a right angle to flow of air/gas mix and functions perfectly in conjunction with the spin exerted on the air/gas mix by air spinner vanes to further enhance turbulence, speed up burn and shorten flame. The retender is flat on the backside and is large in diameter. The turbulent mix deflects off the flat side of the retender, further flattening the flame pattern. The retender is fabricated of a high nickel content alloy, such as RA 310 or INCONEL, to withstand the added operating temperature of about 2,000 plus degrees F. and not oxidize away too rapidly.

The retender on the burner along with the air spinner vanes not only allows a short flame at 100% excess air in the combustion mix but they also prevent any combustion block or boiler pressure from access to gas orifices in the venturi. Any positive pressure on these gas orifices will result in gas flow stoppage from the proportionator valve.

The turbulence results in a short compact flame that increases the number of BTUs per cubic foot of combustion space. The proper sizing and positioning of the retender causes the air-gas mix to deflect off the upstream side of the retender head into the main stream thus creating added turbulence thereby creating a stable flame. The burner creates maximum turbulence in the fire. Hence, a 100% combustion of hydro-carbon fuel and oxygen in the air occurs many times faster than prior art burners.

All of this results in shorter smaller combustion blocks or space requirements. The fires are always bright clear and an excellent emitter of radiant heat. The retender working in conjunction with the spinner vanes result in maintaining the bright clear, short fire at the increased excess air flow rates. This results in a clear flame of less than 8" long burning clean at increased BTUs per hour per sq. ft. of area.

The burner normally has a clear fire which is an excellent source of radiant heat flux. By pressurizing the vessels, pounds of air are added per cubic foot from which to furnish forced convection heat transfer.

The flames of the present invention are always 100% controlled and thus the system always has control of the flue gas. There is also control of the heat transfer to tube walls. The control system is linear and will always maintain the NOX PPM, the CO and the air/gas ratio at any firing rate. Keeping the air/gas ratio the same at every firing rate keeps the other numbers the same. The present system is the only one that will do this.

The high velocity pressure burner system is disposed on a vessel for heating the vessel such as a boiler. The boiler includes an exhaust stack sized to maintain a back pressure on the flue gas passing through the boiler. The combustion system of the present invention is designed to operate with a positive pressure on the flame to produce hot combustion gases that pass through a vessel and out the exhaust stack. The high velocity pressure burner system is operated with excess air in the fire in order to reduce carbon monoxide (CO) in the stack emissions. The excess air reduces the temperature enough to also reduce "thermal NOX". Thus the system is designed to lower objectionable emissions by the simplest and less costly means, while the burner maintains the ultimate energy efficiency and the ultimate in heat transfers.

The exhaust stack I.D. is sized to normally maintain about 2 to 4 inches water column pressure in the boiler (steam generator) or petrochemical process vessel. This pressure ensures that every inch of tube is in contact with the heated combustion gases. By proper sizing of the exhaust stack, high velocity hot combustion gases, normally less than 200 FPS per second, transfers heat by forced convection heat transfer to every square foot of tube surface. The object is to maximize the BTU's per hour per square foot of tube surface at lower than maximum combustion (flame) temperatures.

The present invention uses excess air through the burner in order to lower the maximum flame temperature and eliminate virtually all of the CO and NOX from the exhaust emissions. The hotter the flame, the more NOX emissions that passes through the exhaust stack. In order to reduce NOX emissions from the fired vessel (tube system, boilers, etc.), the initial flame temperature is kept cool enough so as not to produce thermal NOX. All of the burn takes place before anything touches a cold metal surface and by burning all the carbon monoxide, none of the tube walls ever coke up. This provides an excellent source of forced convection heat transfer.

The present invention produces 0 (zero) PPM CO exhaust emissions by using 6% or more excess air. Further, all hot spots are eliminated from the vessels and all soot (coke) build up is totally eliminated due to the elimination of all CO. By passing 100% excess air through the burner, and providing a maximum flame temperature of about 2,200° F., the CO is eliminated and the NOX emissions are lowered to less than 10 PPM of NOX.

A further source of supplemental dilution air may be included at a point downstream of the combustion area and flame. Whether such additional air is used will depend upon the requirements of each individual unit.

The flame of the present invention is steady and stable at sub 10 PPM NOX. The U.V. scanner always sees fire and never shuts down.

At the reduced temperature, the vessel is then heated by high velocity forced convection heat transfer maintaining the velocity of the flue gas through the vessel at a velocity which is compatible with the design of the vessel. There is always some amount of radiant heat involved with flames and flue gas. This invention lowers this radiation to the point of manageability with the high velocity forced convection heat flux to tubes.

By maximizing the heat flux from the flue gas to tube wall, the retention time of the fluid passing through the tubes is minimized. Also by using smaller tubes in the boiler, retention time of the fluid in tubes is further reduced and minimizes the time required to heat the fluid. Water is an almost perfect conductor for the transfer of BTU's. When the diameter of the tubes is minimized, the amount of water passing through the tubes to be heated is reduced and heat only need be conducted across a thin cross section of water. A column of water only 1 mm in cross-section is heated much faster than a column of water one foot thick. Thus, using smaller tubes not only reduces the cross section of the column of water to be heated but smaller tubes also provides more square feet of tube per pound of fluid processed. However, there is a lower limit to the size of the tubes. For example the particles in the water tend to drop out in smaller tubes and collect on the inside of the tubes if the tubes are too small.

Increased heat flux to tubes plus reduced retention time on fluids not only reduces the cost of the units but also saves floor space, saves fuel and reduces maintenance cost. The present invention reduces the time it takes to heat fluids by as much as 90% compared to prior art units.

The exhaust stack temperatures are lower and normally less pounds per hour of heated air are exhausted than the prior art. Further there is increased heat transfer per square foot of tube surface. The present invention also allows the gases to be exhausted at a much lower temperature without causing condensation in exhaust stack.

To attain maximum high velocity forced convection heat transfer to tubes, lower the exhaust gas temperature, and minimize fluid retention time, the fluid preferably flows in the opposite direction of the gas. Cold fluid has to be introduced to boiler at the end the gases are exhausted. The combustion of positive pressure gas, excess air and cold fluid in results in reduced temperature of exhaust gases without condensation. This saves fuel.

In a fire tube boiler, the heat transferred to the furnace tube is increased substantially (as a percentage of the total fire tube boiler heat requirement). The efficiency will always be about 90% or more compared to an industry average of about 80% or less.

The method of the present invention uses the combustion of hydro-carbon fuel and tempering air to create high velocity forced convection heat transfer temperatures to metal tube walls that do not cause excessive deterioration of metal. This is accomplished with a linear, repeatable control system that also results in the low controlled NOX emissions while burning 100% of the CO. The invention also shortens the retention time of the fluids being processed resulting in smaller (at least 50% reduction in size, up to 90% reduction is entirely possible and does occur at times) resulting in smaller, lighter weight units which are less costly in capital outlay, save fuel, save down time and maintenance cost and plant floor space. This invention simply works better than the prior art.

This pressure burner is primarily designed for vessels having tube systems, i.e., petro-chemical process heaters and commercial-industrial boilers, where a high rate of heat release in BTUs per hour, per sq. ft. is required. The system is applicable to fire tube or water tube boilers. The system is not limited to these tube systems only and has a broad range of capability and practical adaptability.

The combustion system improves controllability, improves efficiency, improves heat transfer, improves safety and reduces emissions to the atmosphere such as NOX and CO. The combustion system also reduces the retention time of the product being heated.

Other objects and advantages of the invention will appear from the following description.

BRIEF DESCRIPTION OF THE DRAWINGS

For a detailed description of a preferred embodiment of the invention, reference will now be made to the accompanying drawings wherein.

DESCRIPTION OF PREFERRED EMBODIMENTS

Figure 1:
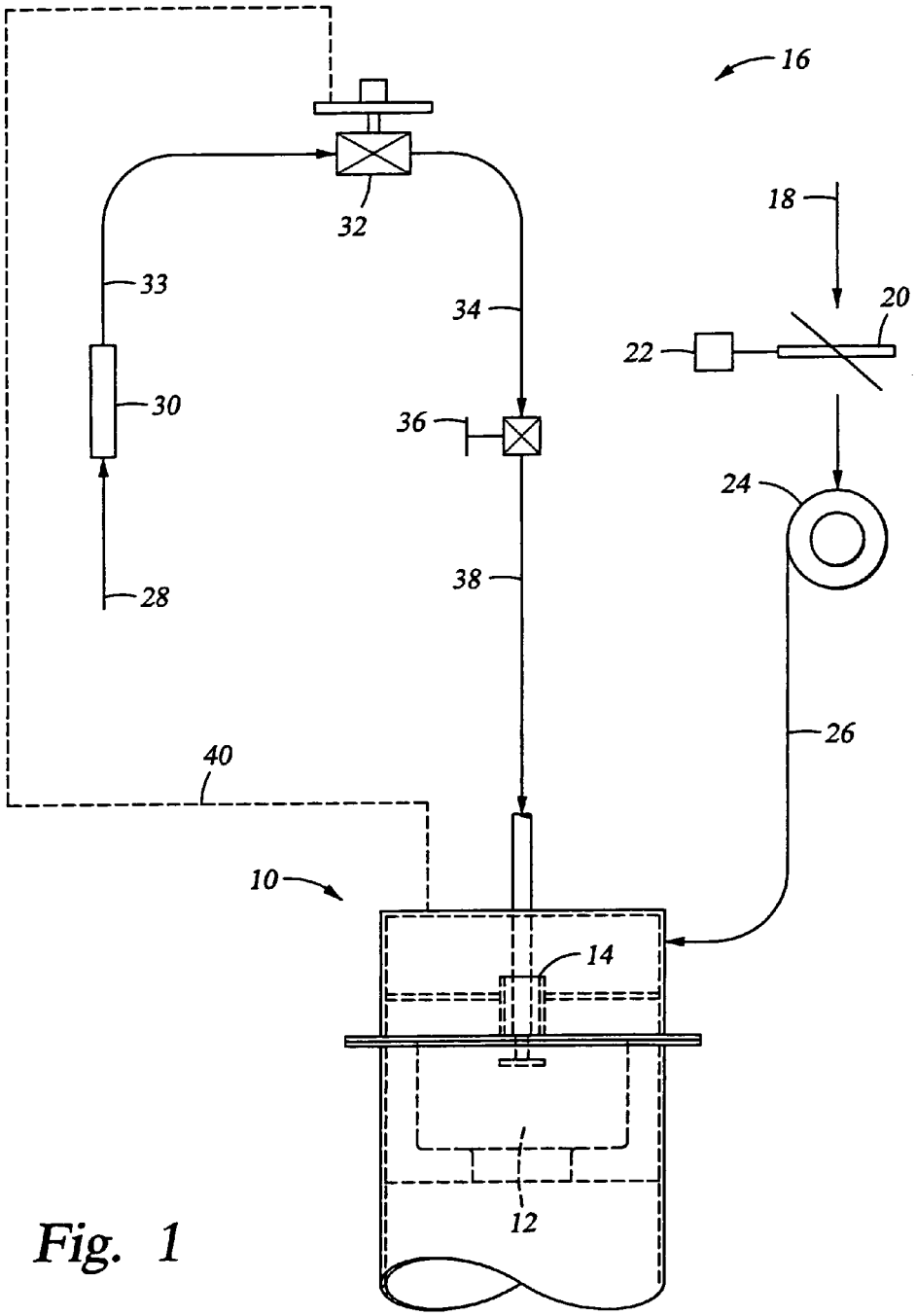
FIG. 1 is an elevational, partially in schematic, of a high velocity pressure burner system in accordance with a preferred embodiment of the present invention.
Figure 2:
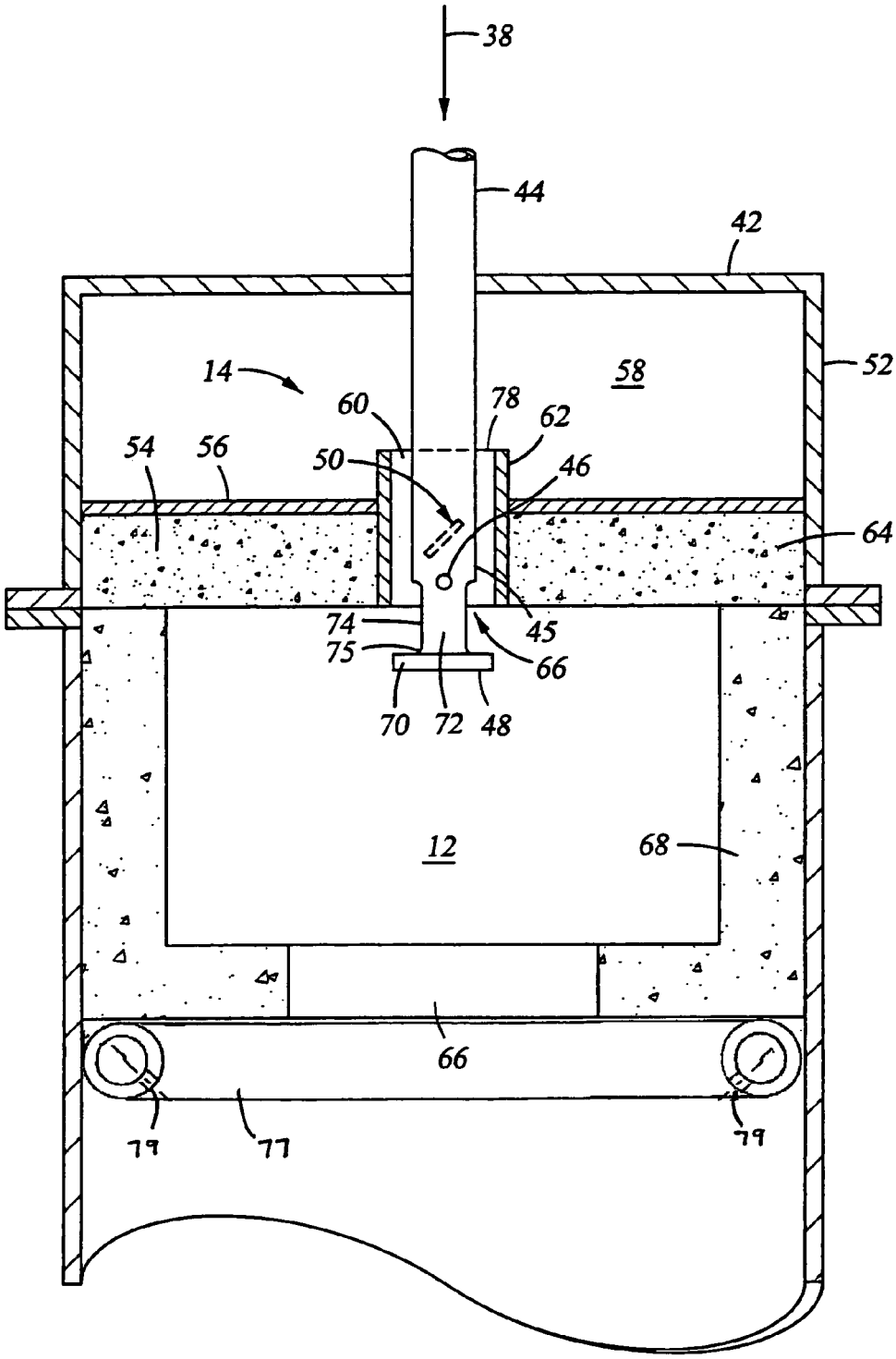
FIG. 2 is an enlarged view, partly in cross-section, of the high velocity pressure burner of the high velocity pressure burner system shown in FIG. 1.

Referring initially to FIGS. 1 and 2, there is shown a high velocity pressure burner system 10 with a combustion chamber 12, a pressure burner 14, and an air/fuel control system 16. Referring particularly to FIG. 1, the control system 16 generally includes an air supply 18, an air control butterfly valve 20 with a modulating control motor 22, an air blower 24, and an air line 26. The control system 16 further includes a fuel supply 28, one or more fuel cutoff valves 30, a gas proportionator valve or regulator 32, a gas line 34, a limiting orifice gas control valve 36, and a gas outlet line 38. The proportionator valve 32 is controlled by operating air pressure via air line 40.

The National Fire Protection Association and Industrial Reassurance Insurers set the industry standards for valves 30.

Induced gas recirculation (IGR) and forced gas recirculation (FGR) may be added to improve efficiency. Air from the exhaust stack is used as combustion air. This recirculation may help fuel consumption. In other words it replaces ambient air with 200° air. One must be careful with flue gas recirculation and 100% of the air should not be replaced with recirculated flue gas. This causes trouble with the fire.

Referring particularly now to FIG. 2, the high velocity pressure burner 14 includes an air manifold 42, a gas manifold or pipe 44, an aspirating means or gas control orifices 46 in gas pipe 44, a retender 48, and a plurality of spinner vanes 50. The burner 14 is housed in a housing 52 which is divided into the air plenum 42 and a refractory section 54 by means of a separator plate 56.

Air manifold 52 is rectangularly shaped and houses gas pipe 44, an upper cover plate, rectangular sides, and an air chamber 58. Bottom separator plate 56 includes an aperture for receiving a mixture housing 62 forming an air-gas mixing chamber 60 with gas pipe 44. The upper cover plate serves both as a cover for the top of the air manifold 42 and a bottom for refractory section 54. Refractory section 54 may be rectangularly shaped to conform with air manifold 42 and includes rectangular sides. Refractory section 56 is packed with refractory 64.

The combustion chamber 12 includes a generally rectangular chamber with a flue gas exhaust port 66. The chamber 12 communicates with the open end 66 of air gas mixture chamber 60 so as to communicate with the burner 14. The open end of flue gas exhaust port 66 forms a flue gas exit into the vessel for heating. The flue gas exhaust port 66 may be narrowed to increase the velocity of the flue gas as it passes through the open end of flue gas exhaust port 66. Combustion chamber 12 is molded by injecting refractory 68 into a mold and ram packing the refractory 68 into the mold. The refractory for system 10 may be Jade-Pak manufactured by A. P. Green. The cubic volume of space required for combustion chamber 12 is reduced since the burner system 10 is operated with a back pressure, and thus, only a very small space is required to achieve a maximum intense flame. This increases the number of available BTU's.

Gas pipe 44 is threadingly connected to outlet gas pipe 38 shown in FIG. 1. The other end 45 of gas pipe 44 extends through mixture housing 62 to form annular air-gas mixture chamber 60. Gas pipe 44 has sufficient length to extend from the outside of air manifold 42 through air chamber 58 and mixture housing 62 in refractory section 54 so as to permit retender 70 to be housed in combustion chamber 12.

Various turbulence means are provided. The aspirating means or the air and gas control orifices provide turbulence and include gas outlet ports azimuthally spaced around the periphery of gas pipe 44 within air-gas mixture chamber 60. Gas control orifices 46 are sized in relation to flue gas exhaust port 66 to provide a predetermined amount of gas and air flowing through air-gas mixture chamber 60.

A plurality of spinner vanes 50 are azimuthally disposed around the end of gas pipe 44 on the side of gas control orifices 46 opposite retender 70. There are preferably six spinner vanes at a 15° angle to the flow of the air. The spinner vanes are straight. The spinner vanes are particularly useful when excess air is used to prevent the formation of a blue flame or a flame that extends outside the combustion block. The spinner vanes 50 are upstream of the gas orifices 46 because the lower velocity of the air gas mixture at the end of the gas pipe 44 allows the flame to burn back into the air orifice. The spinner vanes 50 are located above the gas orifices 46 where there is a higher velocity of the air gas mixture. There is a minimal pressure drop in the range of zero to one-tenth of an inch water column across the spinner vanes 50 and there would be a greater pressure drop if the spinner vanes were to be located downstream of the gas orifices 46. The spinner vanes 50 provide sufficient turbulence to avoid the blue flame and to maintain the flame inside the combustion block.

The retender 48 is downstream of the gas orifices 46 and includes a circular plate or head mounted on one end of a shaft 72 with the other end of shaft 72 plugging and closing the end 45 of gas pipe 44. The diameter of the head on the retender 48 is maximized and is larger than the diffuser shown in the prior art. The diameter of the retender 48 is slidingly received through the ID of the mixture housing 62. The retender is approximately four times the area of the air orifice. Initially the retender shaft 72 has the same outside diameter as the gas pipe 44. The end of the shaft 72 is turned down to form a shoulder with the reduced diameter end portion being slidingly received within the inside diameter of the gas pipe 44. The lower terminal end of the gas pipe 44 engages the shoulder and the shaft 72 is then welded to the gas pipe 44 at the shoulder. A reduced diameter or transition radius portion 74 is then formed around the lower end of the gas pipe 44 and the upper end of the shaft 72 beginning at the mid point of the gas orifice 46 and extends towards the retender head to a radius 75 where the shaft 72 engages the head of the retender 48.

In one embodiment, the reduced diameter is approximately $1/16^{th}$ of an inch smaller than the 2⅜ inch outside diameter of the gas pipe 44. The radius 75 is approximately ¼ inch. The retender 48 projects approximately 1¼ inch into the combustion chamber 12.

It is important to have the gas control orifices 46 large enough to permit free flow of the flue gas out of flue gas exit port 66. Although the area of gas outlet ports of gas control orifices 46 must have some minimum size to assure the exiting of flue gas, the flow of the gas through the system may be regulated by limiting orifice 36 or by a limiting orifice needle valve (not shown) to prevent the sizing of gas control orifices 46 from becoming critical.

Gas pipe 44, air/gas control orifices 46, and air manifold 42 are all air tight to prevent any mixture of the gas with the combustion air prior to mixing an air-gas mixture chamber 60. By preventing any premature mixture of the gas with air, there can be no backfire or burn back since there is no oxygen for the gas to burn.

The air and gas from supply lines 26 and 38, respectively, enter at ambient and are subsequently elevated to a temperature upon combustion at retender 48. With such an elevation in temperature, it is necessary that the gas be permitted to expand in combustion chamber 12 since at any given pressure, one can only burn so much air/gas mixture in a given cubic volume of area in a combustion chamber. Thus, the cross-sectional area of the narrowest part of flue gas exhaust port 66 must be at least 8 times greater than the cross-sectional area of the annular area forming air/gas mixture chamber 60. The resulting flue gas from combustion may be choked down by flue gas exhaust port 66 to increase the velocity of the exiting flue gas and to create a back pressure on burner 14. This choking effect creates a substantial velocity of the exiting flue gas to permit forced convection heating in the vessel.

In one embodiment, the air blower 24 pressurizes the air to approximately 2 psi. Since the velocity of gas flow through gas control orifices 46 is directly proportional to the pressure on the gas caused by the aspiration effect of aspiration means, a change in air pressure will cause a corresponding change in the gas pressure for mixing purposes in burner 14. Since the velocity is directly proportional to the air pressure in air manifold 42, it is only necessary to control the air pressure to also adjust flue gas velocity and the pressure in combustion chamber 12. With the gas being a slave to the air, the air pressure will also control the gas pressure. Thus, the system is completely responsive to the air pressure placed on the system by blower 24. Thus, control system 16 sets the ratio of gas to air in burner 14. The burner may operate at an air pressure between 2/10ths and 56 inches of water column.

The control diameter of the air orifice 78 depends upon the turn down range of the system. For example, if the turn down range is 20 to 1, the annular area through the air orifice 78 must be sized so as to allow air flow within that turn down range. A 5 inch ID of the air orifice housing 62 will allow such a turn down range in the present invention.

With a back pressure in combustion chamber 12, a 2 psi air pressure will cause the flue gas to have a velocity of 500 feet per second through flue gas exhaust port 66. There is an especially good mixture of gas with air using spinner vanes 50 and retender 48 to increase turbulence, back pressure and high velocity, to permit burner 14 to provide substantial heat due to the increased air pressure which achieves flue gas velocities in excess of 200 feet per second. The use of the air enslaving the gas keeps the flame on the combustion side of separator plate 56 from overheating.

Ambient air pipes or ducts 77 with injection orifices 79 may be required in some applications that require lower process temperatures than can be attained by clean combustion of gas and air. Such applications include but are not limited to drying ovens, textile dryers and petroleum heaters. The ambient air systems will allow operation at temperatures from 200 degrees F. to 2,700 degrees F. while not interfering with the low NOX and low CO fires. Ambient air applies to high velocity forced convection heat transfers only.

To achieve maximum efficiency of burner 14, the air/gas mixture is placed in turbulent flow around retender 48 and spinner vanes 50. Such turbulence enhances the mixture of the gas and air and is created by the air and gas trying to rush back into the middle of the ports of gas control orifices 46 to fill voids. Retender 48 maintains pressure on the air/gas mixture for a short distance after the air/gas mixture passes gas control orifices 46. An increase in the flue gas velocity due to an increase in air pressure will increase the turbulence within gas control orifices 46 which assists the efficiency of the burner.

The flame preferably ignites at the periphery 70 of the retender 48. At high fire, the flame ignites just off the periphery 70 of the retender 48. At low fire, the flame ignites along the diameter portion, but a low fire with fewer BTUs does not cause damage to the burner. Preferably the flame is ignited at the periphery 70 of retender 48 and engulfs combustion chamber 12. The burning of the gas/air mixture by the flame creates the flue gas. In the embodiment shown, the air and gas have a pressure of 2 psi creating a flue gas velocity through flue gas exhaust port 66 of approximately 500 feet per second. This velocity of the flue gas creates a back pressure in chamber 12 of approximately 8 inches water column.

The present invention is a short fire burner. With a 2 pound air blower, the flame is approximately 8 inches long.

With the back pressure placed on the burner, the back pressure then creates high velocity in the flue gas. This not only increases the flue gas velocity in the combustion block but also increases the flue gas velocity in the boiler.

In operation, the combustion air may be controlled by V.F.D. motor which would eliminate B.V. and MOD motor (air enters the blower 24 via air control butterfly valve 20 with modulating control motor 22). The air is then compressed by the fan or blower 24 to some positive pressure usually in inches or water column (w.c.). The combustion air then passes through air pipe 26 into air plenum 42 in which it collects a few degrees of preheat from refractory 54 as it passes through the refractory 54 and burner mounting plate 56 by conduction heat transfer. The pressure of the preheated air forces the air into the annular aperture or air orifice 78 around gas pipe 44 and into air-gas mixture chamber 60. The preheated air passes across the spinner vanes 50 and then passes into the venturi area where the venturi creates a partial vacuum on the gas orifices 46.

The fuel, such as natural gas, enters the gas pipe 33, passes through N.F.P.A. and I.R.I. approved safety shut-off gas valves 30, to gas proportionator valve 32 at some pressure above operating air pressure. The proportionator valve 32 is controlled by the operating air pressure via air line 40. The proportionator valve 32 passes the gas out at the same pressure as the operating air pressure. The gas proceeds via gas feed pipe 34 to gas limiting orifice valve 36 then via outlet gas pipe 38 to burner gas feed pipe 44. The gas flowing through gas pipe 44 is preheated by heat transfer from gas pipe 44 by conduction. The gas flows through the gas control orifices 46 where it is entrained due to the partial vacuum caused by the 400 feet per second plus velocity of the air passing across orifices 46 and thus into the stream of air passing through the annular passageway 78 formed by gas pipe 44 within housing 62.

Spinner vanes 50 create turbulence in the air and gas causing the gas to become entrained into the air and a slave to the air as the air passes through the air orifice 78 formed by chamber 60 and then past retender 4870 formed by transition radius 74, radius 75 and the periphery 70 of the retender 48. The air-gas mixes in chamber 60 before exiting to the combustion area, thence becoming the combustion mix as it passes through the venturi exit. 30 to 40% of the combustion mix is bounced off the flat upstream side of the retender 48 into the balance of the combustible mix exiting venturi. The retender 48 causes additional turbulence in the mix as well as it flattens the direction of travel of the mix. The mix exits the retender 48 zone micro mixed and highly turbulent with the same spin, clock-wise when viewed from upstream side, as the spinner vanes 50 rotate the air. These create turbulence in the air/gas mixture and cause the mixture to leave the burner in a fan-shaped pattern where it is burned by the flame. The area of the circle increases rapidly as the mix travels across an ever increasing distance thus slowing the velocity quite rapidly of the combustion mix. The added turbulence exerted into mix by retender 48 plus that already there from spinner vanes 50 plus that which a positive pressure on the fire adds results in a short, about 6" long, compact required which appears clear to the human eye.

Once combustion is complete in the refractory lined combustion block 68, it becomes hot flue gas which has to exit through flue gas exhaust port 66. The sizing of this exhaust port is used to create positive pressure in the combustion chamber 12. Usually about 2" water column is adequate to accomplish uniform complete combustion and temperature control. This reduced port size, i.e., square inch area, will also give an exit velocity usually of 100 to 500 feet per second.

The sizing of burner components is dependent upon the desired flame temperature. If the burner is operated at stoichiometric, the flame temperature will exceed 3000° F. and will generate substantial radiant heat transfer. The flame temperature may reach 3500° F. See U.S. provisional application Ser. No. 60/455,383, filed Mar. 17, 2003 and entitled Pressure Combustion System, hereby incorporated herein by reference. The provisional application was directed to a higher temperature burner relying principally upon radiant heat transfer.

When a radiant heat source is doubled, the radiant heat flux is increased by T1−T2 absolute temperature difference to the fourth power. For example, assuming T1 is 1,600°+800 degrees (50% increase) to 2,400 degrees T2, it increases the radiant heat transfer to receiver 83,700 BTUH or about three times more. Higher T1 temperatures equal increased radiant heat flux to tubes from flue gas.

The sizing of burner components is also dependent upon the desired range of turn down. Turn down range is the range of high fire to low fire of the burner. The range of BTU's produced by the burner is set by the air pressure. At high fire, the maximum air pressure is used to maximize the amount of BTUs produced by the burner, while at low fire, the minimum air pressure is used to minimize the amount of BTU's being produced. The turn down range operates at the same temperature. For example, if the customer wants a 10 to 1 turn down range, then a certain maximum amount of air pressure is required of blower 26. If only a 4 to 1 turn down is desired, then less air pressure is required.

It should be appreciated that the high velocity pressure burner system 10 may be used for heating with respect to any particular vessel. In one preferred embodiment, the vessel is a boiler, such as a fire tube boiler or water tube boiler. It should also be appreciated that the vessel may be a heat exchanger.

Figure 3:
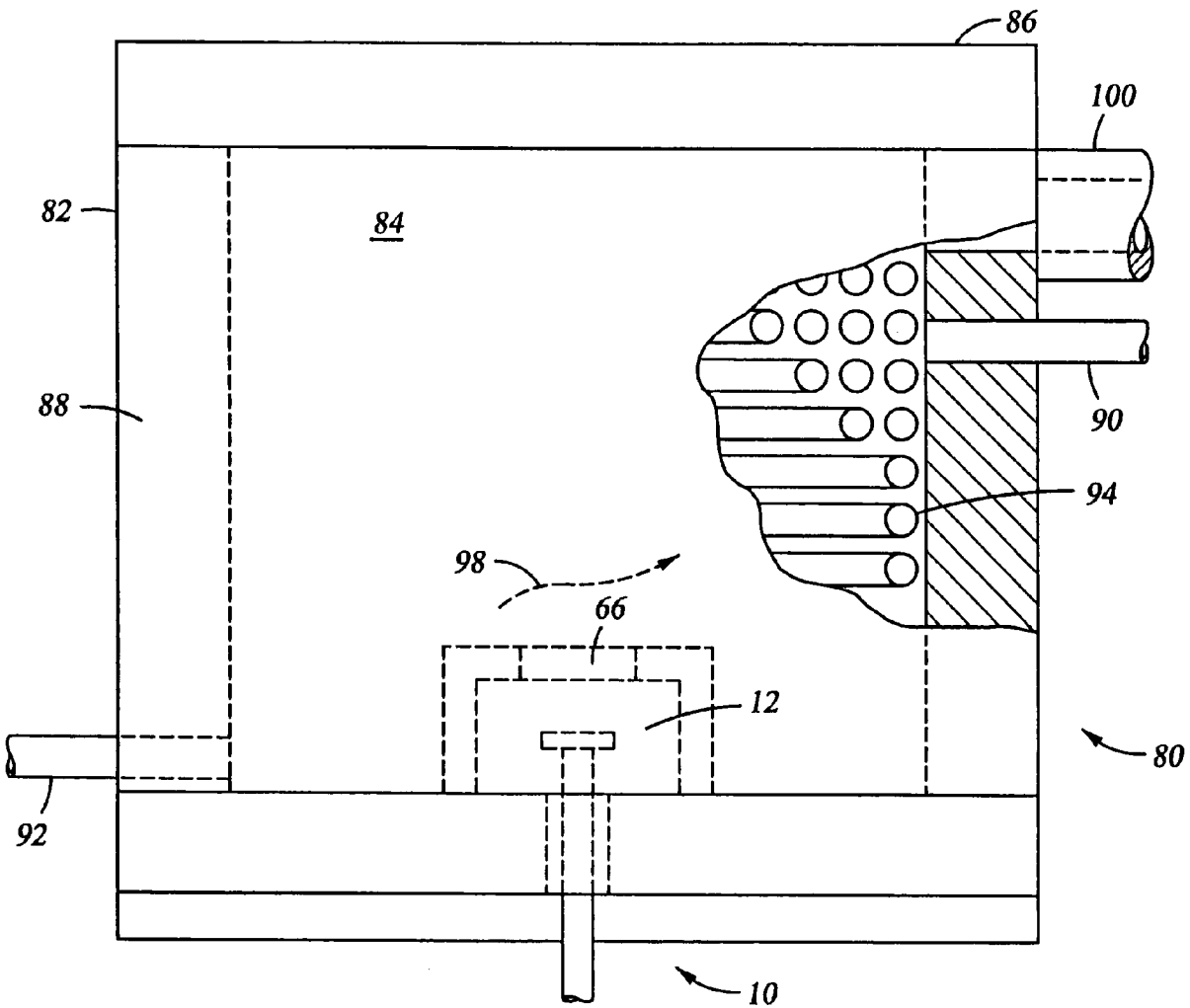
FIG. 3 is an enlarged view, partly in cross-section, of a vessel used with the high velocity pressure burner system shown in FIG. 1.

Referring now to FIG. 3, the high velocity pressure burner system 10 is shown in combination with a boiler 80. Boiler 80 includes a housing 82 forming a chamber 84. Housing 80 includes an upper end 86 with the lower end being formed by burner system 10. The housing 82 is lined with refractory 88. The housing 82 of boiler 80 includes a fluid inlet 90 and a fluid outlet 92. Fluid inlet 90 is in flow communication with a plurality of tubes 94 which in turn communicate with fluid outlet 92. It should be appreciated that the tubes may have any of a number of configurations such as coiled, straight, a combination thereof or some other configuration. Coiled tubes may be preferred because of the expansion of the tubes. A fluid, such as water or other petrochemical, may flow through inlet 90 and through the tubular bore of tubes 94 so as to then exit fluid outlet 92. It should be appreciated that the temperature of the fluid at inlet 90 is less than the temperature of the fluid exiting fluid outlet 92 due to the heat exchange occurring with hot flue gases in chamber 84. An exhaust stack 100 adjacent the inlet end allows the flue gases to exhaust to the atmosphere.

The inside diameter (ID) of the boiler 80 is preferentially sized as well as the size of the tubes in the boiler and the exhaust stack size. It is important that the exhaust stack 100 maintains some positive pressure on the exiting flue gases such as at least $2/10^{th}$ of an inch water column. This positive pressure is enough to cause the flue gases to completely fill the inside of the boiler 80. There is a pressure drop out the exhaust port 66 of the combustion chamber 12 providing the back pressure on the flame. There is another back pressure applied by the sizing of the exhaust stack 100. This back pressure occurs inside the boiler 80.

The velocity of the flue gases through the exhaust port 66 of the combustion chamber 12 depends upon the pressure in the boiler and the air pressure in the burner. The exhaust stack 100 is approximately ¼ the size of the ID of the boiler 80. There is a pressure drop through the boiler 80. The pressure drop of the flue gases through the boiler 80 must be taken into account in sizing the exhaust port 66 of the combustion chamber 12.

There is no relationship between the size of the exhaust port 66 and the ID of the boiler 80. It is dependent upon the number of BTU's being provided by the burner. The amount of excess air in the fire itself is also important.

One objective of the present invention is to achieve low NOX and CO in the emissions from the exhaust stack 100 of the boiler 80. To reduce the NOX and CO, it is necessary to use excess air. NOX emissions vary with BTU per hour (BTUH) heat release, furnace tube size and percent (%) excess air. However in using excess air, the flame temperature of the burner must be reduced. Providing excess air for the burner combustion, eliminates the CO and lowers the NOX generated out the exhaust stack 100. At 100% excess air, the burner is operating with twice as much air as required to burn the gas, i.e. stoiochiometric. At 100% excess air, the temperature of the burner is approximately 2,200° F. and there will be fewer than 10 PPM of NOX exiting the exhaust stack 100. If the burner is operated at 50% excess air, the temperature of the burner will be 2,750° F. and the NOX exiting the exhaust stack 100 will be less than 20 PPM. At 80% excess air, 6 PPM of NOX are produced and zero CO. Such a system in the present invention preferably operates between 50% and 100% excess air.

However, the burner cannot operate at a temperature of 3,500° F. and achieve low NOX and CO because the excess air lowers the burner temperature. Excess air makes it necessary to operate the burner at a lower temperature, such as 2,200° F., to achieve low NOX and no CO.

If the burner were to operate at stoichiometric, then the temperature produced by the burner would be 3,500° F. When the temperature drops from 3,500° F. to 2,200° F., the constituents which assist with heating by radiation drop and therefore heating by radiant heat is reduced substantially in reducing the temperature. Radiant heat transfer is increased by the fourth power when the temperature is doubled. The greater the temperature, the greater exponential return of radiant heat transfer. When the temperature is reduced from 3,500° F. to 2,200° F., the radiant heat transfer is substantially lost and has to be made up by forced convection heat transfer. This requires an increase in flue gas velocity.

To achieve low NOX, the flame temperature must be lowered. Higher temperatures will cause the formation of thermal NOX. The lower temperature lowers the formation of NOX. Because the temperature is now lower, the principal heating must be forced convection heat transfer rather than radiant heat. Radiant heat is provided at higher flame temperatures.

The lower temperature effectively eliminates the radiant heat transfer achievable from higher burner temperatures (in excess of 3000° F.). If NOX were not an issue, then the higher temperature with radiant heat transfer would be preferred. Thus, it becomes necessary to rely upon high velocity forced convection heat transfer and not radiant heat transfer to heat the tubes in the boiler 80. Every time the velocity of the flue gas is doubled, the heat transfer is increased by 50%. This is at the same temperature. If the temperature can be raised without unduly increasing the production of NOX, then the heat transfer is greater than 50% upon doubling flue gas velocity. The radiant heat transfer at 2,200° F. is minimal and only provides a safety factor. The high velocity forced convection heat transfer is dependent upon the velocity of the flue gases passing across the tubes in the boiler 80. Thus another objective is to achieve high velocity flue gas in the boiler 80 and thus a high velocity forced convection heat transfer.

It doesn't make any difference whether the tubes in the boiler are coiled, straight or at an angle with respect to heat transfer. The key parameter is the square feet of area of tube surface. Heat transfer is dependent upon the square foot tube area per degree of temperature per feet per second flue gas velocity. Thus, in the present invention, the flue gas heats the boiler tubes by high velocity forced convection and radiation is only secondarily used because of the reduction in temperature of the flame.

As long as there is 6% excess air or more, zero CO will be produced by the burner. Anything below 6% excess air will produce CO. This is CO in the exhaust stack 100. Prior art burners have a longer flame at these lower temperatures and are unable to burn the CO. The sizing of burner components is also dependent upon how much excess air is used and that is dependent upon how many PPM of NOX one desires to allow through the exhaust stack 100. The ports are typically sized for a 4 inch water column of pressure at the exhaust stack 100 and then are sized relative to the air pressure and turn down.

The delta P at the air orifice is important. If the air orifice is sized to handle 4 inches of water column, and if the back pressure at the exhaust port is 6 to 8 inches of water column, then the air pressure is reduced.

Most boilers operate at less than a 10 to 1 turn down and preferably a 4 to 1 turn down. At a 10 to 1 turn down, in one embodiment, 1½ pounds of air with a 42 inch water column with a 2 inch gas pipe having a 2⅜ inch OD will pass through the air orifice.

The controller on the BFD motor controls the turn down. The design of the boiler dictates the amount of forced convection heat transfer which can be applied to the tubes in the boiler. The larger the ID of the boiler, the greater the velocity of the flue gases leaving the combustion chamber may be to maximum forced convection heat transfer. The flue gases have a velocity of between 200 and 500 feet per second leaving the flue gas exhaust port 66 of the combustion chamber 12.

It is preferred that the flue gases passing through the exhaust stack 100 of the boiler 80 have positive pressure so as to prevent moisture from building up inside the boiler 80. Typically a 2 to 4 inches of water column of the flue gases out of exhaust stack 100 will prevent moisture build up. Raising the temperature of the burner can also avoid moisture.

After the flue gas passes through the flue gas exhaust port 66 of combustion chamber 12 and into the vessel, i.e., the boiler 80, the expanded volume in the boiler 80 reduces the flue gas velocity to approximately 20 to 100 feet per second and more preferably to 20 to 60 feet per second.

The lower flame temperature adds emphasis to the need for turbulence to prevent any burn back of the flame into the air and gas orifices 78, 46. Thus, spinner vanes 50 and the large retender 48 are important to the operation of the burner at these lower temperatures.

In operation, high velocity pressure burner system 10 produces hot flue gases which exit flue gas exhaust port 66 of combustion chamber 12 and into chamber 84 of boiler 80. The hot flue gases transfer heat through the walls of metal tubes 94 to heat the fluid flowing through the tubular bores of tubes 94. The hot flue gases 98 then exit exhaust stack 100.

Figure 4:
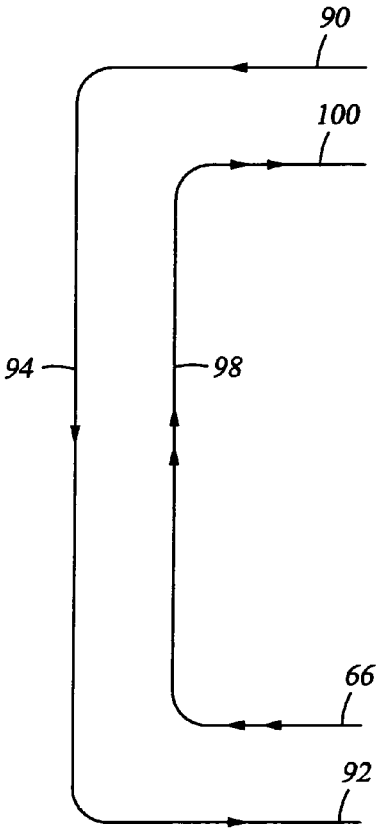
FIG. 4 is a schematic of a contra flow heat flux (transfer) system using the high velocity pressure burner of FIGS. 1 and 2, i.e., a smaller combustion area, increased velocity, and an increased forced convection heat flux.

Referring now to FIG. 4, there is shown a contra flow steam generator. It is preferred that the flow of the hot flue gases 98 be in a direction opposite to that of the flow of the fluid through tubes 94. FIG. 4 illustrates such a contra-flow boiler and petro-chemical heat system. The cold fluid enters through inlet 90 and exits outlet 92 while the hot flue gases enter chamber 84 via flue gas exhaust port 66 and flow in a contra-direction of the fluid and exit exhaust stack 100.

Flue gas at 2-4 inches of water column will result in up to 100 feet per second velocity for forced convection heat flux increase. Every time the velocity is doubled, the BTUH heat flux per sq. ft. will increase by 50% at the same T1 temperature. When the T1 temperature is increased at the same time, the radiant heat flux is increased at a much higher rate by the larger delta T flue gas to receiver and the forced convection heat flux also increases according to the delta T between T1 and T2.

A further limiting factor is the lining and refractory lining the inside of the boiler. If the flue gases have too high a velocity, the flue gases will damage the refractory. Thus, in most refractories, it is necessary to limit the velocity of the flue gases within the boiler to 50 feet per second or less. Thus, the flue gases leaving the combustion block at 400 to 500 feet per second will reduce the velocity within the boiler to prevent damage of the refractory. The refractory may be coated to allow greater velocities of the flue gases through the boiler.

The preferred range of velocity through a typical boiler is 20-60 feet per second. The velocity may be as high as 100 feet per second. However, to reach the higher velocity, the insulation within the boiler would have to be coated or impregnated to avoid damage. Most insulation in the boiler is 4 to 8 pounds per cubic feet of insulative fiber. This type of insulation will blow apart at velocities in excess of 100 feet per second.

The higher the velocity of the flue gases through the boiler, the greater the forced convection heat transfer of the flue gases to the fluid flowing through the tubes of the boiler. Thus, it is desirable to maximize the flue gas velocity depending upon the design of the inside of the boiler.

Each boiler includes a pressure monitor (not shown) which monitors the pressure within the boiler. This pressure monitor is connected to a control panel (not shown) which in turn sends a signal to either the butterfly valve 20 or the BFD motor 22 on the burner so as to adjust the air pressure through the burner if the pressure becomes too great.

The air pressure may be turned down to reduce the number of BTU's where the quantity of steam produced by the boiler needs to be reduced because of less requirement of the steam. If the steam is not being used, pressure will tend to build up in the boiler. When this pressure build up occurs, the controller on the burner idles back cutting the number of BTU's being produced by the burner and thus reduce the heat transfer to the fluid flowing through the boiler. The number of BTU's are turned down when there is less need for the steam.

Figure 5A:
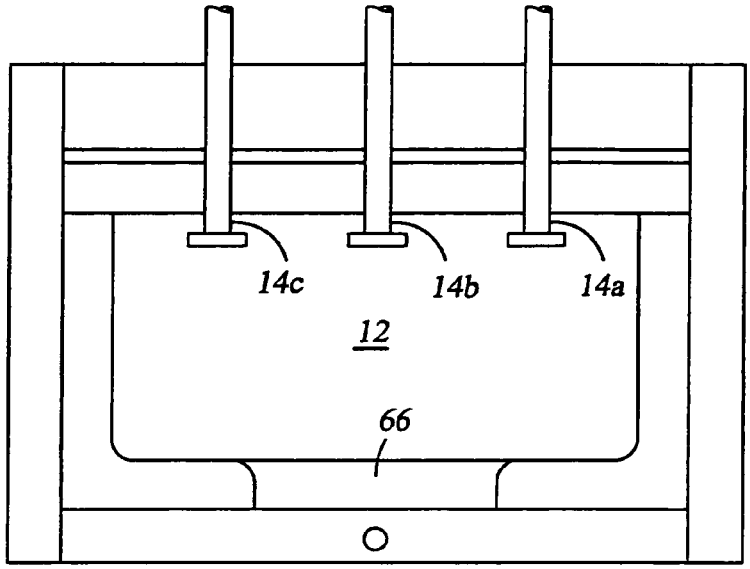
FIGS. 5A and 5B show the high velocity pressure burner system of FIG. 1 combustion with multiple burners being controlled by a common control system, the burners being in a generally circular configuration with the addition of dilution air and supplemental air orifices.

Referring now to FIGS. 5*a* and *b*, it should be appreciated that the high velocity pressure burner system of the present invention may include a plurality of burners 14. Smaller multiple burner heads controlled as one burner increase flame turbulence, reduce refractory required or eliminated.

Figure 5B:
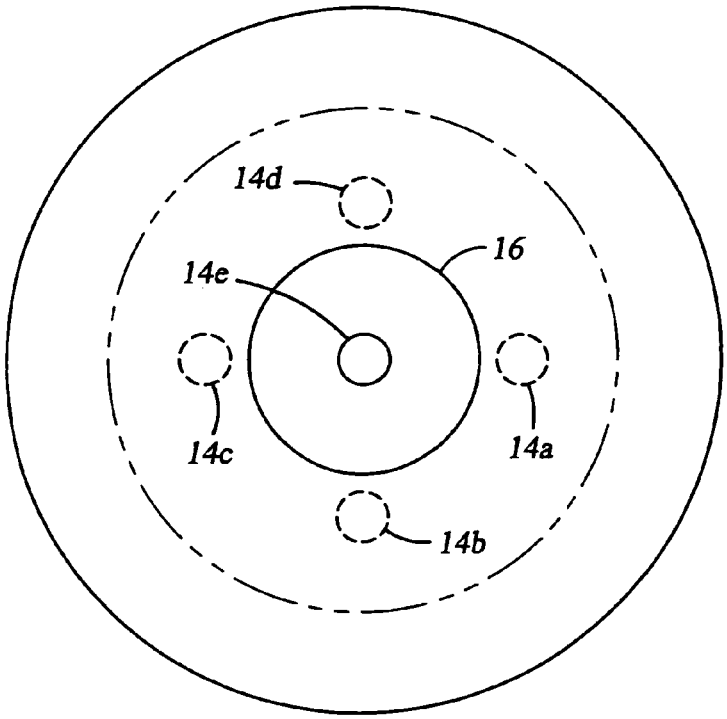

Referring particularly to FIGS. 5*a* and 5*b*, burners 14*a-e*, generate flue gases within combustion chamber 12 with the hot flue gases exiting flue gas exhaust port 66. As best shown in FIG. 5*b*, the burners 14*a-e* may be spaced within a cylindrical air plenum and combustion chamber for mounting directly to a boiler or heat exchanger. Flue gas exhaust port 66 is shown centered within the chamber 12 for the exiting of the hot flue gases.

In a typical boiler, the burners are typically located at the end of the furnace tubes.

In a typical water tube boiler, the boiler has a 2 foot inside diameter and a 4 foot outside diameter and is approximately 20 feet long. The burner may be located on the end of the boiler. However, a series of burners may be disposed along the side of the boiler. Each boiler to provide a uniform heat transfer, the number of BTU's to be produced would be divided among the plurality of burners.

The heat transfer that goes down for each foot traveled in the boiler by the flue gases.

When a plurality of burners are used, one control will control all of the burners.

If the flue gases were to exhaust the stack at atmospheric pressure, moisture will condense inside the boiler. Therefore, it is desirable to have pressurized exhaust air or flue gas passing through the exhaust stack because that pressurized gas will carry more moisture. There are fuel savings by blowing the temperature of a gas out of the exhaust stack and so therefore it is preferable not to increase the temperature so as to carry more moisture but to place a positive pressure on the fuel gas to operate at lower temperature and thus achieve fuel savings.

If the boiler were 20 feet long, the burners would be located in the 1$^{st}$ 10 to 12 feet. The flue gas would pass out the inlet end of the boiler to preheat the incoming fluid.

In the design of a boiler, the expansion of the tubes must be taken into account. Thus, the installation of the tubes within the boiler may be varied to account of the expansion of the tubes. For example, a series of coiled tubes may extend between plates housed and disposed within the boiler.

As long as the stack has at least two inches of water column, the moisture carried by the flue gas will not condense. Four inches of water column might be better. The temperature in the exhaust stack may be approximately 200° F. and have a positive pressure of 2 to 4 inches water column.

Figure 6A:
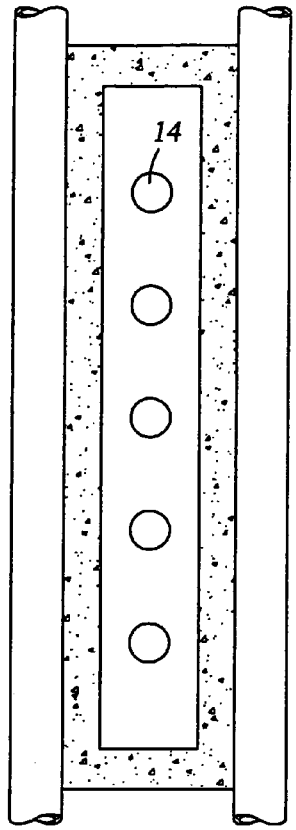
FIGS. 6A and 6B show the high velocity pressure burner system of FIG. 1 combustion with multiple burners being controlled by a common control system, the burners being in a generally linear configuration with the addition of dilution air and supplemental air orifices.
Figure 6B:
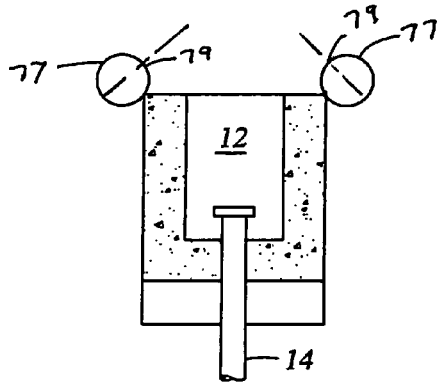

As distinguished from the embodiments of FIGS. 5*a* and 5*b*, FIG. 6 shows a plurality of burners 14 disposed linearly within the air plenum and combustion chamber 12.

It may be possible to avoid the combustion chamber and use the boiler as the combustion chamber with the exhaust stack 100 applying the back pressure to the burner.

Dilution air may be required in some cases. Dilution air with or without I.G.R. (induced flue gas recirculation or F.G.R. may or may not be furnished air from the combustion air blower 24) or it may have a separate dilution air blower (which is not shown in drawings).

Figure 7:
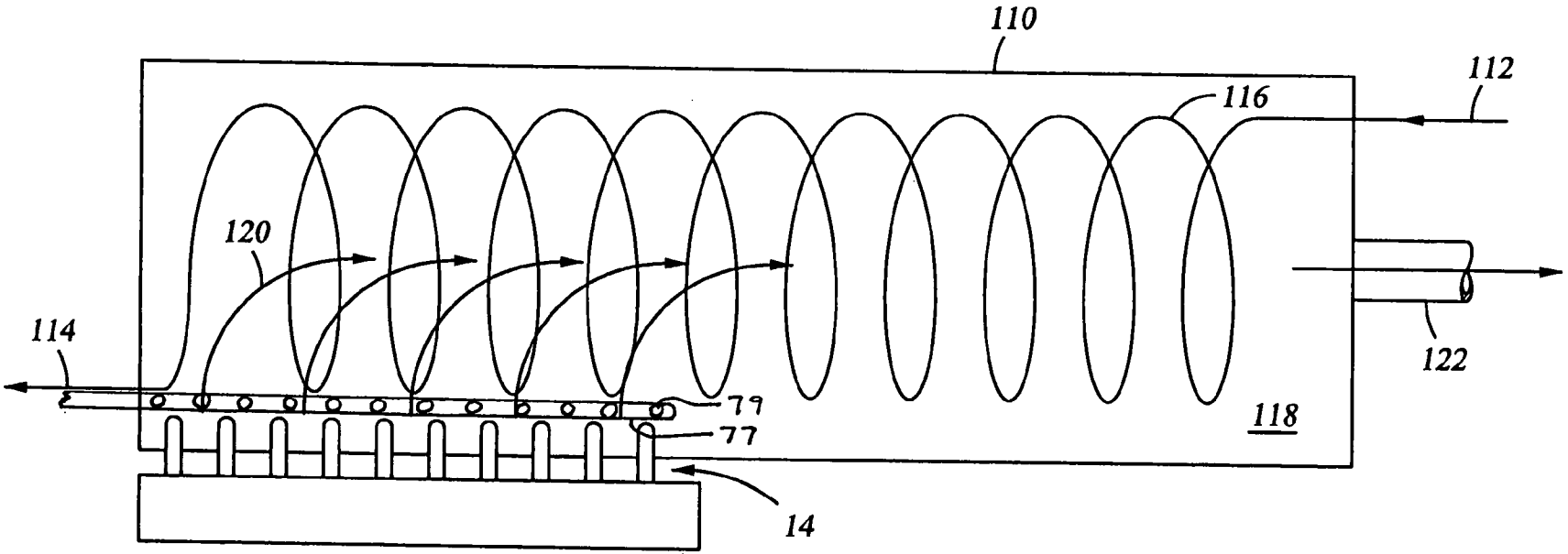
FIG. 7 is an elevation view, partially in cross-section, of a vessel with multiple burners mounted thereon for heating fluids passing through the vessel.

Referring now to FIG. 7, there is shown a boiler 110 having a fluid inlet 112 and a fluid outlet 114 communicating with coiled tubing 116 extending through the chamber 118 of boiler 110. It should be appreciated that chamber 118 may be lined with refractory (not shown). A plurality of burners 14 are mounted adjacent the outlet end of boiler 110 for generating flue gas 120 which exits exhaust stack 122. It can be seen that the flue gases adjacent the outlet end of boiler 110 will have a greater temperature than the flue gases which have moved to a location adjacent the inlet end of boiler 110. As the hot flue gases travel across the boiler tubes 116, the temperature of the flue gases will be reduced. The lower temperature of the flue gases at the inlet end will provide a preheat to the cool fluid entering the first portion of boiler 110 from fluid inlet 112. Thus, the fluids passing through the tubes in the latter half of boiler 110 will have a higher temperature and thus be heated to even greater temperatures by the hotter flue gases adjacent the outlet end. Such a process permits a greater heating efficiency of the boiler 110.

The present invention offers many advantages. A combustion system that eliminates coking (soot) from all surfaces: reduced down time and maintenance cost; total energy savings; reduction in the tons per year of pollutants while saving fuel; reduction in the size and capital cost of process heat equipment; saving of plant floor space; burner burns more BTU's out of fuel supplied; dramatically increasing turbulence in the flame; makes the heat transfer many times faster; increases radiant heat flux from flue gas to receiver; dramatically increases radiant heat transfer to receiver; cleans up CO, a major pollutant to the atmosphere; and system that improves safety, will not burn back, flash back or back fire. These advantages can also be accomplished on a low temperature high velocity drying systems.

While a preferred embodiment of the invention has been shown and described, modifications thereof can be made by one skilled in the art without departing from the spirit of the invention.

The invention claimed is:

1. A high velocity pressure burner system for burning air and gas thereby creating a flue gas, the system comprising:

a blower for pressurizing the air;

a control for adjusting the pressure of the pressurized air;

a combustion chamber having a flue gas outlet;

a burner disposed on the combustion chamber comprising:

an air/gas mix chamber formed between air and gas conduits and having an inlet and an outlet;

an air orifice in the air conduit communicating with the mix chamber for receiving the pressurized air;

a gas orifice in the gas conduit communicating with the mix chamber for receiving the gas;

the pressured air flowing between the air and gas conduits over the gas orifice in the mix chamber to enslave the gas in the air and form an air/gas mixture;

at least one spinner vane disposed within the mix chamber upstream of the gas orifice in the mix chamber causing the pressurized air to create a partial vacuum on the gas orifices;

a retender disposed downstream of the gas orifice at the exit of the mix chamber, the air/gas mixture impinging on the retender creating turbulence in the air/gas mixture;

the air/gas mixture being combusted by a flame after leaving the mix chamber; and the flue gas outlet sized to create a back pressure on the flame of the burning air/gas mixture.

2. The system of claim 1 further including a proportionator valve automatically proportioning the gas to the air.

3. The system of claim 1 wherein the combustion chamber has a refractory lined block with a reduced size flue gas exhaust port causing a pressure drop which creates the back pressure on the flame.

4. The system of claim 1 wherein the pressurized air flow over the gas orifice forms a venturi mixer and further including maximizing the velocity of the air allowed by the blower across the spinner vanes and out of the venturi mixer and retender into combustion chamber achieving maximum turbulence and flame propagation.

5. The system of claim 1 wherein the air/gas mixture impinges onto the retender completing the finite mixing of the hydrocarbon atoms and oxygen atoms in the air.

6. The system of claim 1 wherein the retender redirects the direction of flow of the high velocity air/gas mixture at high fire to aid in the turbulent flow of the air/gas mixture.

7. The system of claim 1 wherein the retender acts as flame stabilizer.

8. The system of claim 1 wherein the retender is made of high nickel content material.

9. The system of claim 1 wherein the retender flattens the air/gas mixture and flame to reduce the velocity of the burning air/gas mixture in the combustion chamber to improved combustion.

10. The system of claim 1 wherein the burner allows the turbulence to dictate the time and temperature of the combustion.

11. The system of claim 1 wherein the flue gas outlet places a back pressure on the downstream side of the flame of the burning air/gas mixture.

12. The system of claim 1 flue gas outlet is reduced to increase the velocity of the exiting flue gas which increases the heat flux per square foot of receiver via forced convection.

13. The system of claim 2 the proportionator valve maintains the same ratio of gas to air at any firing rate and percentage of excess air on either high fire or low fire or any point in between.

14. The system of claim 2 wherein proportionator valve results in a linear control of gas to air by controlling the pressure across orifices without the coordination of valves.

15. The system of claim 2 wherein the proportionator valve maintains a linear control of the gas to the air regardless of firing rate.

16. A high velocity pressure burner system for burning air and gas thereby creating a flue gas to heat a boiler, the system comprising:

a blower for pressurizing the air;

a control for adjusting the pressure of the pressurized air;

a combustion chamber having a flue gas outlet;

a burner disposed on the combustion chamber comprising:

an air orifice for receiving the pressurized air;

a gas orifice for receiving the gas;

the air orifice causing the pressured air to flow over the gas orifice to draw the gas into the air orifice to form an air/gas mixture;

a retender disposed downstream of the gas orifice;

the air/gas mixture exiting the air and gas orifices and impinging upon the retender creating turbulence in the air/gas mixture;

the air/gas mixture burning to form hot flue gases which flow through the flue gas outlet;

the flue gas outlet being smaller than the combustion chamber causing the hot flue gases to exit through the flue gas outlet at a high velocity;

a boiler having a housing with an exhaust stack and a plurality of tubes for flowing a fluid therethrough;

the flue gas outlet communicating with the housing causing the hot flue gases to flow directly over the plurality of tubes to heat the plurality of tubes by high velocity forced convection heat transfer; and the flue gas outlet sized to create a back pressure on the burning air/gas mixture and communicating with the boiler to pass the hot flue gases across the tubes of the boiler and out the exhaust stack, the exhaust stack being sized to maintain a back pressure on the flue gas passing through the boiler.

17. The system of claim 16 wherein the flue gas outlet is sized with respect to the combustion chamber to create a positive pressure within the combustion chamber producing an exit velocity in excess of 100 feet per second and the exhaust stack is sized with respect to the housing to maintain this positive pressure on the hot flue gas passing through the boiler and around the tubes, causing increased turbulence around the tubes to achieve a uniform heat flux to the entire surface of the tubes.

18. The system of claim 16 wherein the control sets the burner to operate at a temperature of 2200° F. and 100% excess air thereby burning CO from the flue gasses passing through the flue gas outlet and increasing the heat flux from the flue gas to the tubes by high velocity forced convection.

19. The system of claim 16 wherein the control linearly controls the proportion of air and gas for the air/gas mixture to cause the emissions of NOX and CO in PPM to remain the same throughout the range of pressure of the air from high to low fire.

20. The system of claim 16 wherein the control includes a proportionator providing a linear control and wherein the flue gas outlet creating a back pressure causes a positive pressure within the combustion chamber to achieve a complete burn.

21. The system of claim 16 wherein the control includes a proportionator providing a linear control and wherein the flue gas outlet creating a back pressure causes a positive pressure within the combustion chamber to reduce the number of pounds of heated air being exhausted to atmosphere at any given temperature.

22. The system of claim 16 wherein the flue gas outlet is sized with respect to the combustion chamber to create a back pressure and cause a positive pressure within the combustion chamber increasing heat transfer to the tubes to reduce the temperature of the exhaust stack flue gas.

23. The system of claim 16 wherein the flue gas outlet is sized with respect to the combustion chamber to create a back pressure and cause a positive pressure within the combustion chamber to increase heat flux from the flue gas to the boiler tubes.

24. The system of claim 16 wherein the control linearly controls the proportions of gas and air in the air/gas mixture over the range of fire and wherein the flue gas outlet creating a back pressure causes a positive pressure within the combustion chamber to reduce NOX emissions at all firing rates, without any additions such as flue gas recirculation, steam injection or staged fuel or air.

25. The system of claim 16 wherein the control includes a proportionator providing a linear control and wherein the flue gas outlet creating a back pressure causes a positive pressure within the combustion chamber to achieve a complete burn to prevent the accumulation of carbon on the tubes.

* * * * *